US005362249A

United States Patent [19]

Carter

[11] Patent Number: 5,362,249

[45] Date of Patent: Nov. 8, 1994

[54] SHIELDED ELECTRICAL CONNECTORS

[75] Inventor: Andrew L. Carter, Saratoga, Calif.

[73] Assignee: Apple Computer, Inc., Cupertino, Calif.

[21] Appl. No.: 58,522

[22] Filed: May 4, 1993

[51] Int. Cl.[5] ..... H01R 13/53

[52] U.S. Cl. ..... 439/357; 439/181; 439/609

[58] Field of Search ..... 439/357, 607, 609, 181, 439/183, 186, 350

[56] References Cited

U.S. PATENT DOCUMENTS

| | | | |
|---|---|---|---|
| 4,516,825 | 5/1985 | Brennan et al. | 439/607 |
| 4,929,189 | 5/1990 | Sekiguchi | 439/357 |
| 4,936,793 | 6/1990 | Uchida | 439/357 |
| 5,083,945 | 1/1992 | Miskin et al. | 439/607 |

FOREIGN PATENT DOCUMENTS

| | | | |
|---|---|---|---|
| 2909616 | 9/1980 | Germany | 439/357 |

*Primary Examiner*—Gary F. Paumen

*Attorney, Agent, or Firm*—Heller, Ehrman, White & McAuliffe

[57] ABSTRACT

An electrical connector system which includes a socket shell member and a plug shell member that mate to establish electrical connection between them. Each shell member has a detent device and these detent devices can engage with each other when the plug shell member is inserted into the socket shell member so as to releasably keep the plug and socket shell members in the electrically connected position. The detent devices have front-ends with sharp points or edges which are capable of attracting electrostatic discharge.

11 Claims, 4 Drawing Sheets

SHIELDED ELECTRICAL CONNECTORS

The present invention relates generally to shielded electrical connector systems having mated socket and plug connectors, and more particularly to a novel feature included on the electrically conductive shield shells for such connector systems that can act as both a protective attraction point for electrostatic discharge and as a mechanical detent latching mechanism.

BACKGROUND OF THE INVENTION

Shielded electrical connector systems have been widely used with electrical cables in electronics applications, such as data communications equipment, computers and digital information systems. Electrical plug connectors are typically used to terminate cables that have a multiplicity of electrically conductive signal leads or wires. In most applications, it is necessary to shield the signal-carrying conductors and circuits from electromagnetic interference (EMI) and/or radio frequency interference (RFI). Shielding is used to protect the conductors and circuits from both EMI that emanates from the different electronic components within a system as well as from outside sources.

To provide protection from such interference, electrical cables used in electronic equipment have shielding in the form of a sheath of conductive material between the outer cable jacket and the insulated conductors. The shielding can be formed from a variety of conductive materials, such as aluminum foil or braided copper wire.

Electrically conductive shields or shells are also placed around the terminal plug and socket connectors of the electrical cables. The plug and socket connectors form a shielded "input-output" connector system for cables which are designed to connect distinctly different and physically separated electronic components or equipment.

It should be generally understood for the purposes of the discussion herein that the plug connectors are mounted on the ends of multiconductor cables and that the socket connectors are mounted on stationary panels of the housings of various types of electronic equipment. It is, of course, possible to use either type of connector mounted on a cable or mounted on a piece of equipment.

A typical shielded plug connector has a plurality of electrical contacts that form the terminal ends of the cable. The contacts are mechanically positioned and retained within an insulating structure formed of dielectric material and are the functional part of the plug connector. The contacts are designed to be brought into intimate interconnection or mating with a counterpart socket which has complementary structural and electrical contact features. The shield for the plug connector is typically an electrically-conductive enclosure or shell that is connected to the shield sheath of the cable. The socket connector has a counterpart shield shell that is mateable with the plug shield shell. The socket shield shell is in electrical connection with the "shield" of the electronic equipment, i.e., the housing. Different mounting schemes for the socket shield shells are known in the art. The shield shells are typically fabricated using stamped and formed sheet metal. The shape of the shield shells can be varied. For example, the shield shells can be rectangular, circular, cylindrical, polygonal, etc.

An electrostatic discharge (ESD) can occur between two conductive bodies that are charged at different levels, thereby creating a potential difference. When the two bodies are brought into proximity, a discharge or spark can jump between them resulting in an electric current that can induce destructive effects in sensitive electronic circuitry, especially if no protective measures are taken. Sources for ESD may include the hands or body of a person handling electric cables or electronic equipment, as well as any metal, tools or incidental materials.

Three strategies are typically used for preventing damage caused by ESD. First, the sensitive circuits can be made less sensitive or vulnerable to ESD, so as to be capable of absorbing a discharge. Second, sensitive circuits can be insulated by means of physical barriers or separation from potential sources of ESD; for example, sufficiently thick layers of air and/or various dielectric material can be used. Third, the ESD can be provided with a means for being conducted away from sensitive circuitry to a location where it can be harmlessly dissipated. The present invention is intended to be employed in conjunction with this third strategy.

To protect against ESD, as well as the aforementioned EMI and RFI, the shielding used in electrical connector systems must sufficiently surround the electrical contacts so that, when the connectors are unmated, any ESD will discharge to the shielding rather than to the electrical contacts. It has been found, for a given arcing distance in air, that ESD is attracted to conductive objects with sharply pointed features, as compared with ones that which lack sharp points or edges. In other words, a discharge will preferentially strike the sharp feature.

In addition, for many electrical connector systems, a latching or locking mechanism is used to retain the plug and socket connectors in the mated position to prevent them from inadvertently separating and causing a system failure. In some cases, this mechanism may be incorporated in the shield shells of the respective plug and socket connectors. The latching or locking function may be accomplished by means of a "detent." For example, the plug connector can have one or more latching features projecting in a direction perpendicular to the direction of mating/unmating. The socket connector can have counterpart latching features designed to engage the plug latching features, thereby preventing a movement in the direction of unmating when the plug and socket connectors are fully mated.

As defined herein, a detent is a means for permitting releasable locking or latching of mateable connectors and for retaining the connectors in a fully mated position. Examples of different types of latching means include jackscrews, slide locks, wire bail locks, bayonets, snap rings, etc.

The manufacturing costs for the connector shields can contribute considerably to the total cost of a connector system. Moreover, electrical connectors are often used in appreciable numbers in a single electronic device, such as a computer or telecommunications apparatus. It is therefore desirable to reduce the cost of manufacture for electrical connectors by simplifying the design of the shielding.

In addition, the physical space constraints of increasingly compact electronic device designs have also significantly impacted the design of connectors. The result is that connectors must also be smaller and more compact. When designing ESD features and detent features for connectors, problems associated with achieving functionality and manufacturability can arise because of the size requirements. The present invention addresses these design problems by providing small and compact shield shells for electrical connectors that have novel ESD and detent features.

It is an object of the present invention to provide an electrical connector system having a mechanical detent feature that also acts as an attraction point for electrostatic discharge.

It is another object of the present invention to provide electrical connector shield shells that have a mechanical detent feature combined with an ESD feature that can be manufactured easily and at low cost.

It is still another object of the present invention to provide an electrical connector system that will not inadvertently separate or unmate.

Additional objects and advantages of the invention will be set forth in the description which follows, and in part will be understood from the description, or may be learned by practice of the invention. The objects and advantages of the invention may be realized and obtained by means of the elements recited and particularly pointed out in the claims.

SUMMARY OF THE INVENTION

The present invention relates to an electrical connector system comprising a socket member, plug member and a means for releasably locking the socket and plug members in a mated, engaged position. The releasable locking means has a sharp point and/or edge feature that is advantageously located for attracting electrostatic discharge.

The releasable locking means comprises a first and second detent means that engage each other at their respective engaging step portions when the plug and socket members are in the fully mated position. At the point of engagement, the first detent means has an internally facing surface that engages an externally facing surface of the second detent means. The ESD attraction feature can be placed on either the first and second detent means.

In the preferred embodiment, the electrical connector system has electrically conductive shield shells for substantially surrounding and shielding the electrical contact members housed within the plug and socket connectors. The socket connector has a shell member with at least one first detent means in the form of a spring-loaded cantilever beam. The plug connector has a shell member with at least one second detent means in the form of a projection member that is positioned to correspond with the cantilever beam. The projection member has an elevated portion with sharply pointed forward edges acting as attractive features for electrostatic discharge. The cantilever beam and the projection member have engaging step portions that engage when the plug shell member is fully inserted in the socket shell member.

BRIEF DESCRIPTION OF THE DRAWINGS

The accompanying drawings, which are incorporated in and constitute a part of the specification, schematically illustrate embodiments of the invention and, together with the general description given above and the detailed description of the preferred embodiment given below, serve to explain the principles of the invention.

DESCRIPTION OF THE PREFERRED EMBODIMENTS

The present invention will be described in terms of its various embodiments. The preferred embodiment is an electrical connector system having a plug shell member and a socket shell member that substantially surround and shield the electrical contacts housed therein. The socket or plug shell members of the present invention can be manufactured with a feature that provides ESD protection when the plug and socket connectors are unmated and provides a detent latching function when the plug and socket connectors are mated. The present invention combines the ESD attraction feature with the mechanical detent feature.

Throughout herein, "front" will mean the end-parts of the plug and socket connectors that are typically brought together when mating the connectors, and "forward" will mean the direction in which a mating connector is advanced during the act or maneuver of mating.

In the present invention, the plug shell member and the socket shell member each have a detent feature which engage in a complementary position when plug and socket connectors are fully mated. Different types of known detent means can be employed by the present invention, provided a suitably positioned sharp edge or point can be incorporated as an ESD feature. For example, one that engages and releases under prevailing force, or one that requires the actuation of an engage/-release means, such as a button or lever. In addition, different types of detent devices can be used together in combination. The present invention can be used with different known connector systems; for example, a connector system that uses pin-and-socket contacts.

In addition, it is within the scope of the present invention to provide the ESD attraction feature on either of the plug or socket shell members. It is preferable to place the ESD feature on the plug shell member. The sharp ESD attraction features are positioned so that a discharge will preferentially strike the ESD attraction features rather than the electrical contact members which are substantially surrounded and shielded by the plug and socket shell members.

Figure 1:
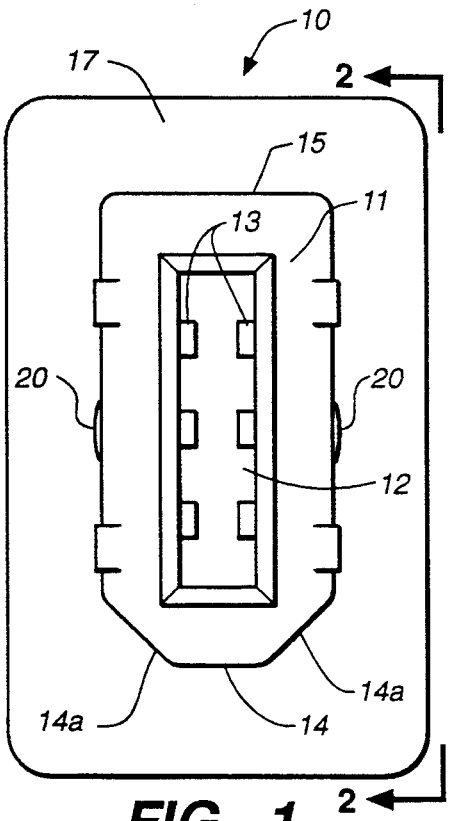
FIG. 1 is a front schematic view of the plug shell member of the present invention.
Figure 2:
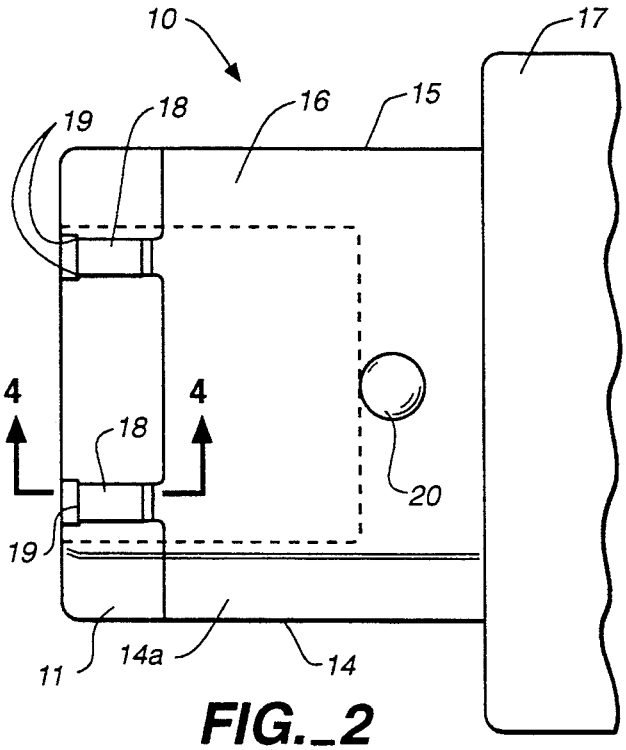
FIG. 2 is a side schematic view of the plug shell member of the present invention along lines 2—2 of FIG. 1.
Figure 3:
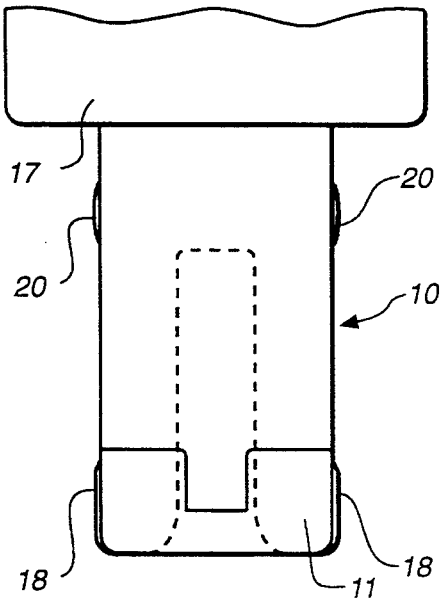
FIG. 3 is a top schematic view of the plug shell member of the present invention.

Referring now to the drawings, FIGS. 1 through 3 show a plug shell member 10 as generally rectangularly shaped. In FIG. 1, numeral 11 indicates a "nose" member which is a front component of the body or insulated portions of a plug connector. The insulated portions of the plug connector are made of a suitable rigid dielectric polymer material, such as polyamide, polyester, polyphenylene sulfide, etc. The nose member 11 has a slotted opening 12 that permits engageable access to electrical contacts 13 housed within the plug shell member 10. The number of electrical contacts 13 will vary according to the number of conductive leads or wires in a particular cable. In this embodiment, the contacts 13 are of the "ribbon" style. It is within the scope of the invention to use different contact styles, such as pin-and-socket contacts.

Figure 5:
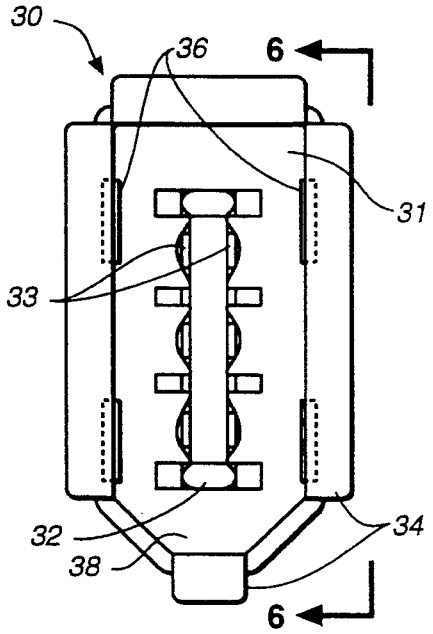
FIG. 5 is a front schematic view of the socket shell member of the present invention.
Figure 6:
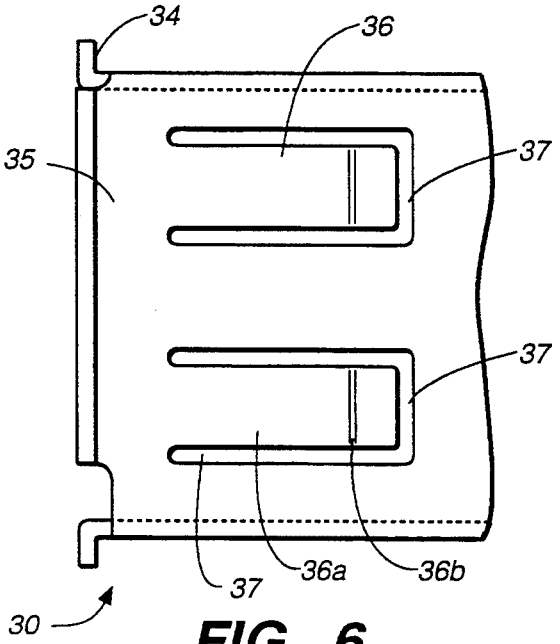
FIG. 6 is a side schematic view of the socket shell member of the present invention along the lines 6—6 of FIG. 5.
Figure 7:
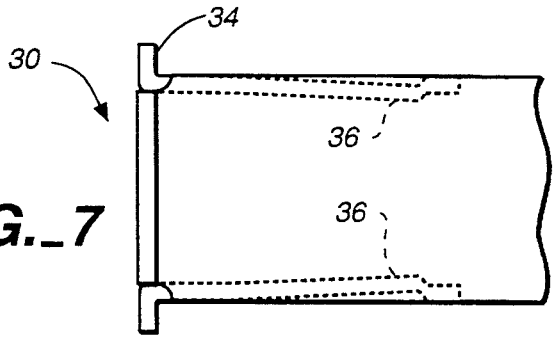
FIG. 7 is a top schematic view of the socket shell member of the present invention.

It is preferred that the outer edges of the nose member 11 and the edges of slot 12 be beveled or rounded to facilitate the insertion of plug shell member 10 into a mating socket shell member 30, as shown in FIGS. 5 through 7. The bottom portion 14 of the plug shell member 10 has two chamfered edges 14*a* that establishes one correct orientation for mating with the counterpart socket shell member 30.

Referring to FIG. 2, the plug shell member 10 encloses the mating area (shown by the dotted lines) and extends into a boot portion 17, which surrounds and mechanically secures the cable (not shown) and the conductive wires therein (not shown) connected to the electrical contacts 13. The top wall 15, bottom wall portions 14 and 14*a*, and sidewalls 16 of the plug shell member 10 are made of a conductive material. In the preferred embodiment, the plug shell member 10 is made of two pieces of stamped and formed sheet metal. The detent projection members 18 are forward-pointing extensions of the main body of the plug shell member 10. Shown projecting from each sidewall 16 are two detent projections members 18. There are four detent projections members in the preferred embodiment. The number of detent means can be varied from one to as many as desired or needed to provide sufficient latching action and ESD protection. It is required that at least one be used with each sidewall when the plug shell member 10 is rectangularly shaped.

According to the preferred embodiment of the present invention, the ESD feature 19 has four pointed corners and four edges that provide attraction points for ESD.

Figure 4:
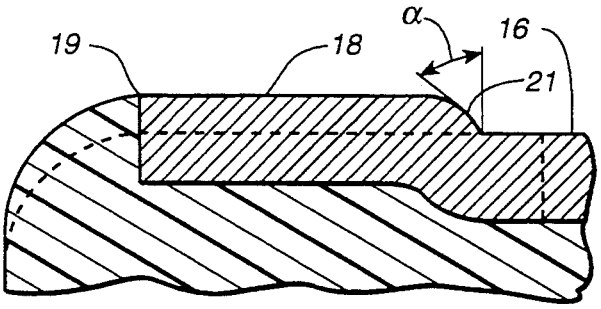
FIG. 4 is a sectional schematic fragmentary view of the detent and ESD features of the present invention along lines 4—4 of FIG. 2.

In this embodiment, as shown in FIG. 4, the ESD feature 19 has only two corners and one edge that are exposed.

The detent/ESD features can have other shapes for example, a triangular tip comprising two pointed corners and one edge. The number of corner points and edges is determined by the surfaces which intersect to define the shape of the projection member 18. The "sharp" edges, corners and tips formed by the intersection of two or more surfaces can be created without using special manufacturing steps. The metal stamping and forming process of the preferred embodiment will produce sheared edges that have a radius at the intersecting surfaces of typically less than 0.1 mm. The sharpness of the edges and points can be enhanced using conventional sharpening techniques.

The nose member 11 of the plug connector is designed and manufactured to accommodate the combined detent projection member 18 and the ESD feature 19. The ESD features are designed to be as far forward as practical and/or necessary to provide ESD protection for the electrical contacts 13 of the plug connector.

As seen more clearly in FIG. 3, the detent projection member 18 rises and is elevated from the surface of the sidewalls of the plug shell member 10. The plug shell member 10 can optionally include anti-rocking bumps 20 for providing additional stability when the plug shell and socket shell members are mated.

FIG. 4 is an enlarged fragmentary view of the detent projection member 18. The detent projection member 18 has an engaging step portion 21 that rises at an angle $\alpha$ with the perpendicular from the surface of the sidewalls. It is preferred that the angle e be between 40 to 50 degrees. The angle can be made greater or smaller depending on the combination of retention force and prevailing release force to be used in the connector system. The engaging step portion 21 provides the engaging means for releasably mating the plug shell member 10 with the socket shell member 30.

Referring to FIG. 5, the socket shell member 30 has a receptacle or cavity opening 31 formed by top, bottom and sidewalls that are shaped to accommodate the plug shell member 10. In this embodiment, the socket shell 30 is a generally rectangular housing. The socket shell 30 is fabricated from metal or other electrically conductive materials. Within the cavity 31 is projecting contact support member 32 that holds blade or ribbon-like electrical contacts 33. The projecting contact support member 32 is shaped and positioned to be insertably fitted into slot 12. Flanges 34 are formed along a substantial portion of the periphery of cavity 31 by outwardly turning portions of socket shell 30.

Referring to FIG. 6, two detent cantilever beams 36 are formed in and cantilevered from each sidewall 35 of socket shell member 30. The cantilever beam 36 has an inwardly sloped portion 36*a*, beginning near the dotted line shown, and engaging step portion 36*b*. The engaging step portion 36*b* is shaped to complement the engaging step portion 21 of projection member 18. The cantilever beams 36 are preferably formed by creating slits 37 in the sidewall 35 and then forming or stamping the resulting beam between closed dies. Thus, in the preferred embodiment, there are no additional material costs to manufacture the detent cantilevers, because it is fabricated from the same piece of material used to form the socket shell member 30. The socket shell member 30 is preferably fabricated from a single piece of metal or other electrically conductive material.

In this embodiment, it is preferable to use four identical detent cantilever beams 36, although only two detents are required. Naturally, the number of detent cantilever beams on the socket shell member 30 will correspond with the number of detent projection members on the plug shell member 10. The positioning of the combined detent and ESD features near the forward end of the plug connector makes it possible for the cantilever beam to be relatively long, while being formed out of the same stock material as the shield shell member 30. A longer cantilever beam offers greater flexibility of design to achieve the desired properties of resiliency or spring, mating retention, and prevailing release force.

According to the preferred embodiment, the socket connector has an insulating body member molded of a suitable rigid dielectric plastic material. The body member includes a bulkhead 38 and the projecting contact support member 32 which retains electrical contacts 33. The bulkhead 38 supports and aligns the projecting contact support member 32 within the shield shell member 30 and provides a stop for the plug connector when it is in the fully mated position.

Referring to FIG. 7, the detent cantilever beams 36, represented by the dotted lines, are shown to form a gentle slope inward from the sidewalls. This is shown in greater detail in the sectional view of FIG. 8.

Figure 8:
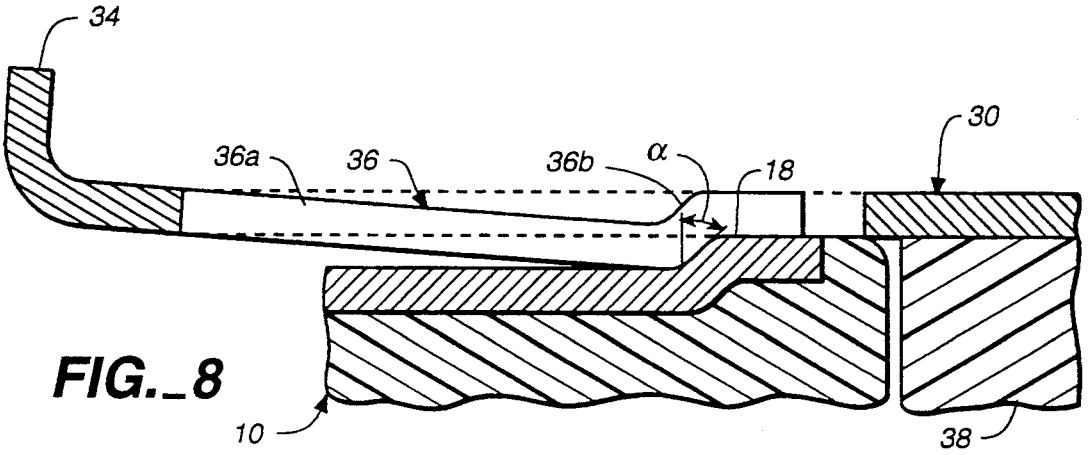
FIG. 8 is a sectional schematic view of the present invention with the plug shell member engaged with the socket shell member.

Referring to FIG. 8, the socket shell member 30 is shown in the engaged position with plug shell member 10. The cantilever beam 36 is shown to be lockably engaged with projection member 18. As the plug shell member 10 is inserted into the socket shell member 30, the nose member 11 pushes against the inwardly sloped portion 36*a* of the cantilever beam 36 causing it to move outward. As the plug shell member 10 becomes fully inserted, the detent cantilever beam 36 moves inward as the engaging step portion 36*b* passes the raised section of detent projection member 18 causing the engaging step portions of the detent projection and cantilever beam to become engaged. The engaged detent features 18 and 36 provide mechanical interference which prevents unintentional movement in the direction of unmating. The application of a sufficiently large or prevailing force in the direction of unmating will overcome the frictional force of the detent features and will release the plug connector from the socket connector.

Figure 9A:
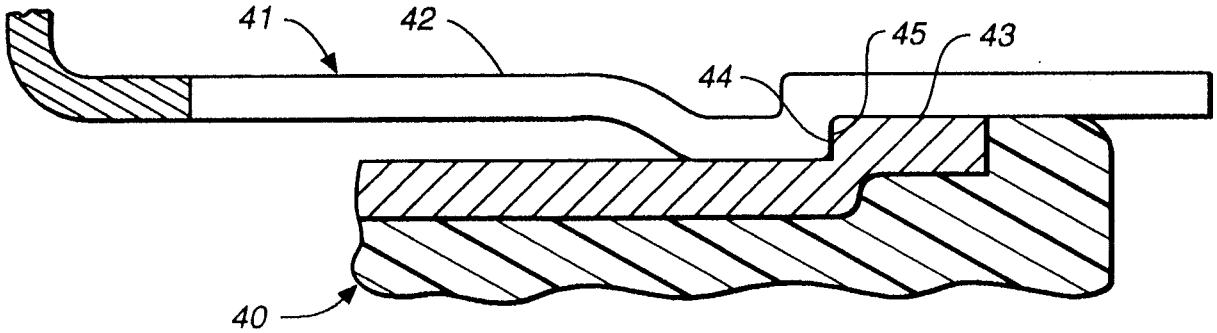
FIG. 9A is a sectional schematic view of an alternative embodiment of the present invention with the plug shell member engaged with the socket shell member.
Figure 9B:
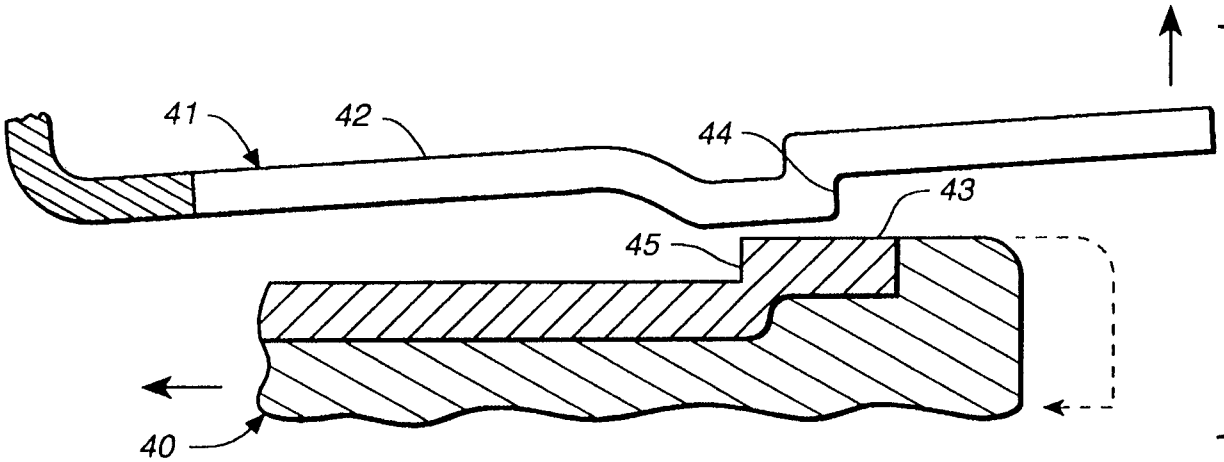
FIG. 9B is a sectional schematic view of the alternative embodiment shown in FIG. 9A with the plug shell member partially disengaged from the socket shell member.

Referring to FIGS. 9A and 9B, an alternative embodiment of the present invention is shown that requires the application of a releasing actuation force in order to effect the release of the plug shell member 40 from the socket shell member 41. The plug shell member 40 has a detent projection member 43 with an engaging step portion 45. Engaging step portion 45 forms a sharply angled step with a surface portion that is perpendicular to the sidewall of the plug shell member 40. The socket shell member 41 has a detent cantilever beam 42 with an engaging step portion 44 that has a surface portion that is perpendicular to the sidewall of the socket shell member 41 and that is complementary with engaging step portion 45 of the detent projection member 43.

As shown in FIG. 9A, when the plug shell member 40 and the socket shell member 41 are in the mated position, the engaging step portion 45 of the detent projection member 43 and the engaging step portion 44 of the detent cantilever beam 42 are in intimate cofacial engagement. As shown in FIG. 9B, the releasing actuation force acts on the detent cantilever beam 42 to lift the engaging step portion from the engaged position and this permits the plug shell member 40 to be unmated from the socket shell member 41. The release actuation means (not shown) can be in the form of a button, a lever or any number of different conventional mechanisms that would be apparent to one of ordinary skill in the art. Depending on the type of detent device used, the releasing force may be applied to either the first or second detent means.

Figure 10:
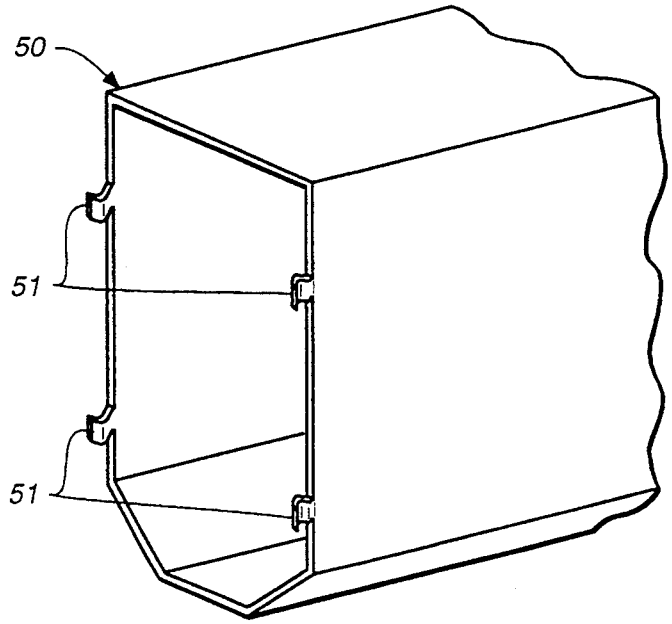
FIG. 10 is a three-quarter schematic view of a second alternative embodiment of the socket shell member of the present invention with projection detent features.
Figure 11:
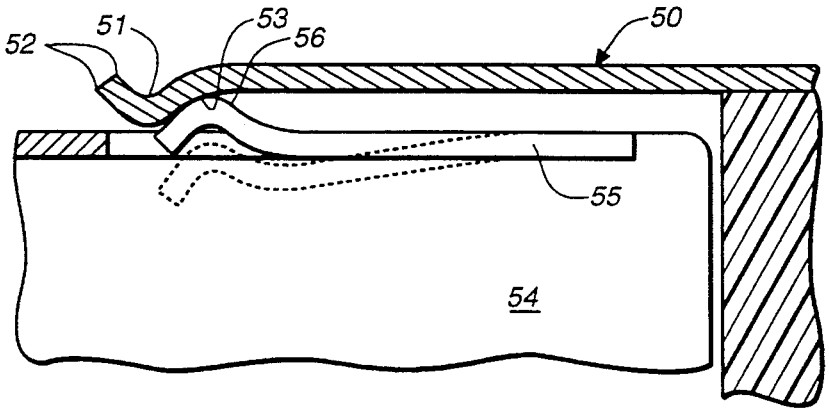
FIG. 11 is a sectional schematic view of a second alternative embodiment of the plug shell member engaged with a second alternative embodiment of the socket shell member.

Referring to FIG. 10 and 11, another alternative embodiment of the present invention is shown wherein the socket shell member 50 has detent projection members 51 projecting from its front section. The ESD feature 52 is positioned at the front-ends of the detent projection members 51. The plug shell member 54 has a detent cantilever beam 54 that is movable in an inward direction to permit the plug's engaging step portion 56 to move past the socket's engaging step portion 53 when mating with the socket shell member 50. When fully mated, the detent cantilever beam 54 of the plug shell member 53 springs back to its original position with the engaging step portion 55 engaging the engaging step portion 51 of the plug shell member 50.

Figure 12:
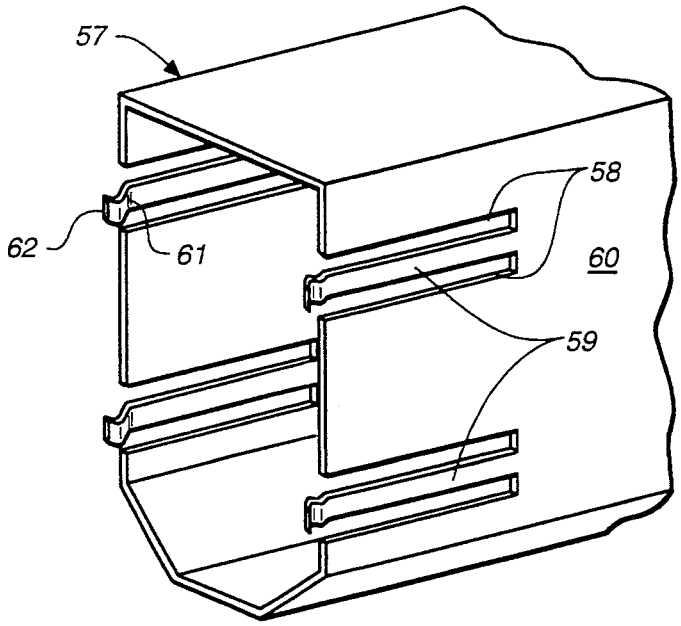
FIG. 12 is a three-quarter schematic view of a variation of the alternative embodiment for the socket shell member shown in FIG. 10.

In FIG. 12, still another alternative embodiment for the socket shell is shown. The socket shell member 57 has a detent cantilever beam 59 that is formed by slits 58 in sidewall 60. The engaging step portion 61 is formed near the front-end portion of the detent cantilever beam 59 with the ESD feature 62 formed at its end. The length of the detent cantilever beam can be varied to permit the ESD feature 62 to be positioned as desired.

The present invention has been described in terms of the various embodiments set forth above. The invention, however, is not limited to the embodiments depicted and described.

What is claimed is:

1. An electrical connector system comprising:

a socket having a front end, at least one first contact and a shell with at least one first detent means;

a plug having a front end, at least one second contact and a shell with at least one second detent means said plug being insertable into said socket to establish an electrical connection between said first and second contacts when said plug and socket are in a locked position;

said first and second detent means being engaged with each other when said plug is in said locked position so as to releasably retain said plug in said locked position; and either said first or second detent means having an electrically conductive forward pointing sharp front-end part located near said front end of said socket or said plug and in front of said first or second contacts to attract electrostatic discharge.

2. The electrical connector system of claim 1 wherein said first detent means has an internally facing surface and said second detent means has an externally facing surface, said internally and externally facing surfaces being similarly contoured so as to allow mateable engagement with each other when said plug means is in said locked position.

3. The electrical connector system of claim 1 wherein said second detent means has an externally facing surface with a second engaging step portion.

4. The electrical connector system of claim 3 wherein said first detent means has an internally facing surface with a first engaging step portion capable of engaging with said externally facing surface of said second detent means.

5. The electrical connector system of claim 1 wherein said first detent means is cantilevered from said socket means and said second detent means having said front-end part capable of attracting electrostatic discharge projects from said plug means.

6. The electrical connector system of claim 1 wherein said first detent means projects from said socket means and having said front-end part capable of attracting electrostatic discharge, and said second detent means is cantilevered from said plug means.

7. The electrical connector system of claim 1 wherein said first detent means being cantilevered from said socket means and having said front-end part capable of attracting electrostatic discharge, and said second detent means is cantilevered from said plug means.

8. The electrical connector system of claim 2 wherein said internally and externally facing surfaces each have a perpendicularly rising step portions capable of engaging each other and being disengaged by a releasing actuation force which is applied in a direction perpendicular to the direction of insertion.

9. The electrical connector system of claim 1 wherein said socket means further comprises a first shield shell member incorporating said first detent means and said plug means further comprises a second shield shell member incorporating said second detent means.

10. The electrical connector system of claim 9 wherein said first and second shield members are shaped to permit mateable interconnection.

11. An electrical connector system comprising plug and socket connectors having electrically conductive shield shells comprising:

a socket shell member comprising a polygonal first housing having top, bottom, front and rear sections and opposite sidewalls that form a cavity, the front section of said first housing defining an opening for said cavity, the top section of said first housing being a flat surface, the bottom section of said first housing having angled side portions connecting with the opposite sidewalls of said first housing, each sidewall of said first housing having at least one spring-loaded cantilever beam, said cantilever beam having a sloped portion that slopes inwardly into said cavity and a first engaging step portion, the rear section of said first housing having a projecting contact support;

a plug shell member comprising a polygonal second housing having top and bottom sections and opposite sidewalls shaped to conform with and to be insertable received by said cavity, each sidewall of said second housing having at least one projection member in a corresponding position with said cantilever beam of said socket shell member, said projection member having a sharp forward edge capable of attracting electrostatic discharge and a second engaging step portion that outwardly rises from the sidewall of said second housing, said second housing having a front nose member that has a slot defining an opening for a receptacle contact support, said slot and said receptacle contact support being shaped to insertably receive said projecting contact support, said second housing having a rear portion attached to a boot member for receiving a conductor cable; and said socket shell member and said plug shell member being releasably mateable at said first and second engaging step portions.

* * * * *

UNITED STATES PATENT AND TRADEMARK OFFICE

CERTIFICATE OF CORRECTION

PATENT NO. : 5,362,249
DATED : November 8, 1994
INVENTOR(S) : Andrew L. Carter

It is certified that error appears in the above-indentified patent and that said Letters Patent is hereby corrected as shown below:

Column 6, line 26, replace "angle e" with –angle $\alpha$–.

Claim 11, column 10, line 13 replace "insertable" with –insertably–.

Signed and Sealed this

Third Day of January, 1995

*Attest:*

*Attesting Officer*

Bruce Lehman

BRUCE LEHMAN

*Commissioner of Patents and Trademarks*